US007798087B2

(12) United States Patent
Leeuwenburgh

(10) Patent No.: US 7,798,087 B2
(45) Date of Patent: Sep. 21, 2010

(54) ATTACHMENT OF WATERSKI TOW BRACKET TO TOWING VESSEL

(75) Inventor: Peter Leeuwenburgh, Achterweg 33, BA Herwijnen, NL-4171 (NL)

(73) Assignee: Peter Leeuwenburgh, BA Herwijnen (NL)

( * ) Notice: Subject to any disclaimer, the term of this patent is extended or adjusted under 35 U.S.C. 154(b) by 0 days.

(21) Appl. No.: 12/280,728

(22) PCT Filed: Feb. 26, 2007

(86) PCT No.: PCT/NL2007/000053

§ 371 (c)(1),
(2), (4) Date: Dec. 29, 2008

(87) PCT Pub. No.: WO2007/097620

PCT Pub. Date: Aug. 30, 2007

(65) Prior Publication Data

US 2009/0217853 A1 Sep. 3, 2009

(30) Foreign Application Priority Data

Feb. 27, 2006 (NL) ..... 1031250

(51) Int. Cl.
*B63B 21/56* (2006.01)

(52) U.S. Cl. ..... 114/253; 248/514

(58) Field of Classification Search ..... 114/251, 114/253, 254, 361, 364; 248/514, 538; 403/173, 403/174

See application file for complete search history.

(56) References Cited

U.S. PATENT DOCUMENTS

| | | | | | |
|---|---|---|---|---|---|
| 2,667,317 | A | * | 1/1954 | Trebules | 248/514 |
| 2,920,598 | A | * | 1/1960 | Nielsen | 114/253 |
| 2,929,348 | A | * | 3/1960 | Jackson | 114/253 |
| 3,029,041 | A | | 4/1962 | Child | |
| 3,034,469 | A | * | 5/1962 | Allen | 114/253 |
| 3,056,977 | A | * | 10/1962 | Mcguire | 114/253 |
| 3,134,356 | A | * | 5/1964 | Holtshouser | 114/253 |
| 3,336,894 | A | * | 8/1967 | Eisner | 114/253 |
| 3,417,726 | A | * | 12/1968 | Marino | 114/253 |
| 3,583,355 | A | * | 6/1971 | Smith | 114/253 |
| 4,213,413 | A | | 7/1980 | Courtney | |

FOREIGN PATENT DOCUMENTS

WO 2007/097620 A1 8/2007

OTHER PUBLICATIONS

International Search Report (PCT/ISA/210) issued in the corresponding NL application No. PCT/NL2007/000053, completed on Jul. 5, 2007 and mailed on Jul. 12, 2007.

* cited by examiner

*Primary Examiner*—Lars A Olson
(74) *Attorney, Agent, or Firm*—Griffin & Szipl, P.C.

(57) ABSTRACT

A mounting of a ski line bracket includes the attachment of a ski line bracket (1) of the type whereby the ski line can roll along a circular tube by means of a pulley, wherein attachment of the bracket uses an attachment device of the outboard engine to the transom of the boat. The attachment allows that the operating position of the bracket to be set and fixed while the bracket can be lifted with some friction. Mounting elements have flanges (4) with holes that correspond to those of the outboard engine attachment device.

20 Claims, 2 Drawing Sheets

ATTACHMENT OF WATERSKI TOW BRACKET TO TOWING VESSEL

This is a National Phase Application in the United States of International Patent Application No. PCT/NL2007/000053 filed Feb. 26, 2007, which claims priority on Dutch Patent Application No. 1031250, filed Feb. 27, 2006. The entire disclosures of the above patent applications are hereby incorporated by reference.

FIELD OF THE INVENTION

The invention comprises the mounting of a ski line bracket of the type whereby the ski line can roll along a circular bar by means of a pulley. Particularly when using heavier outboard engines for towing water skiers it is important that the position of the bracket is as horizontal as possible. The ski line will drop into the wake when the bracket hangs down and will disturb the water skiing. Also it is important that the operating position of the bracket is set to the expected angle of the boat when being driven, which depends of various factors. The bracket should not disturb the tilting of the outboard engine.

BACKGROUND OF THE INVENTION

Heavier outboard engines usually are permanently mounted to the transom of the boat. In many cases it is not desirable to mount the ski line bracket to the outboard engine. Boats with inboard engines also benefit from a ski line bracket.

SUMMARY OF THE INVENTION

The invention preferably concerns mounting of the bracket using the transom mounting device of the outboard engine. The mounting requires that the working position of the bracket can be set and fixed while the bracket can be lifted with some friction. It may be advantageous to leave out the friction. The mounting elements have flanges with holes matching those of the outboard engine motor bracket.

In accordance with an embodiment of the present invention, a mounting of a ski line bracket is characterised in that the ski line bracket (1) is mounted to pivoting plate (8) which rotates with friction around rotation point (5) which is anchored to base plate (2) whereby bolt (12) fits into a circular opening (6) and bolt (12) in combination with circular opening (10) forms an adjustable stopper. In accordance with another embodiment of the invention, the previous embodiment is modified so that the setting angle of pivoting plate (8) by the stopper by means of bolt (12) lies between 10 and 25 degrees. In accordance with yet another embodiment of the present invention, the previous embodiments are further characterised in that the pivoting plate (8) can pivot over an angular degree between 20 and 30 degrees, in combination with opening (6), with friction. In accordance with still another embodiment of the present invention, the previous embodiments are further characterised in that the pivoting plate (8) can pivot over an angular degree between 20 and 30 degrees, in combination with opening (6), without friction. In accordance with still another embodiment of the present invention, the previous embodiments are further characterised in that bolt (14) can be a cap nut.

BRIEF DESCRIPTION OF THE DRAWINGS

The invention is discussed with help of the drawings.

DETAILED DESCRIPTION OF THE INVENTION

Figure 1:
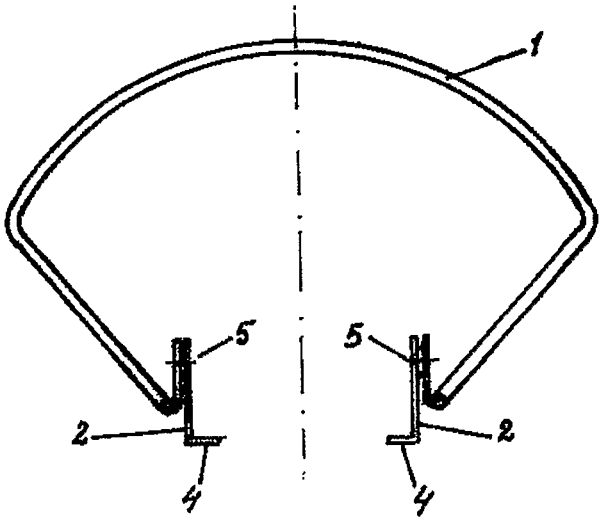
FIG. 1 shows the ski line bracket top view.
Figure 2:
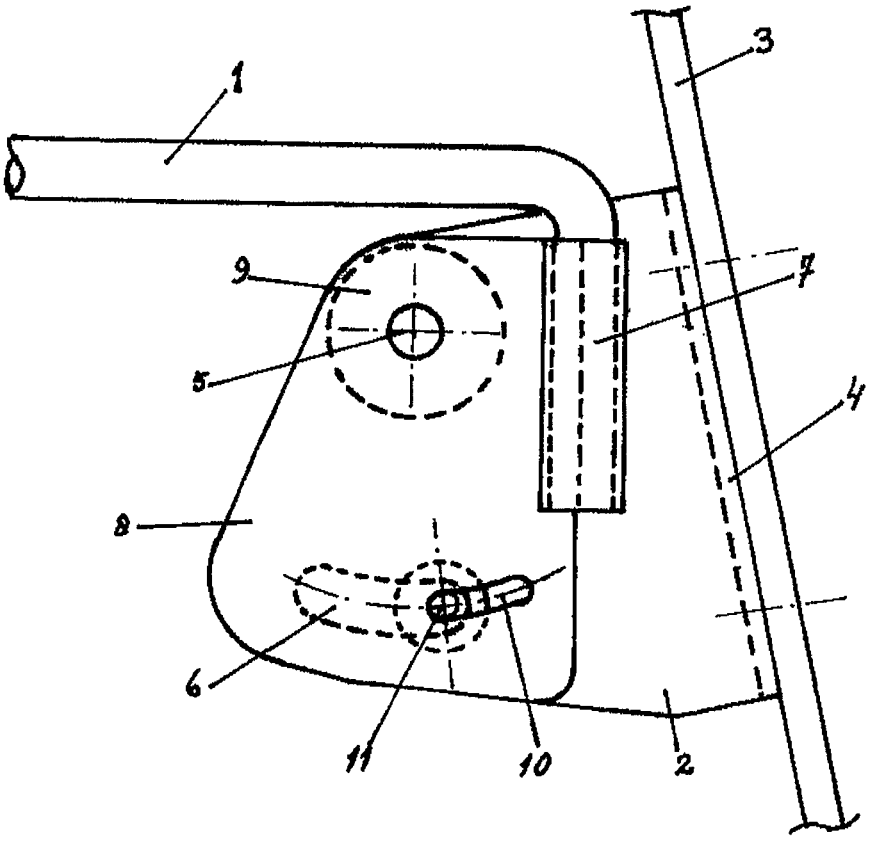
FIG. 2 shows the mounting device in side view with the ski line bracket in horizontal position.
Figure 3:
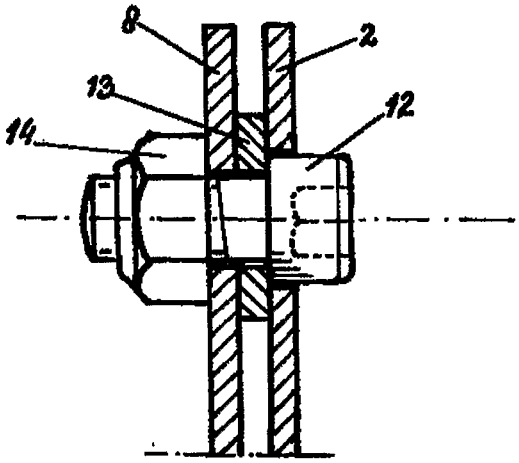
FIG. 3 shows the adjusting bolt.

In FIG. 1, (1) designates the ski line bracket which is mounted to base plates (2) to the transom (3) of the boat. The ski line bracket (1) has a circular part of which the centre point practically coincides with the vertical axis of rotation of the outboard engine, or for that matter the axis of rotation of the rudder in case of an inboard engine. Base plate (2) is mounted to the transom with flange (4). At (5) base plate (2) has a hole for a rotation point. Furthermore a circular opening (6) of which the centre point is located in the centre of rotation point (5). Bracket (1) is inserted into tube (7). Tube (7) is welded to pivoting plate (8) which has a hole at (5) so that pivoting plate (8) can rotate around a (not drawn) bolt with spring. Between base plate (2) and pivoting plate (8) is at (5) a disc (9) of friction material. In pivoting plate (8) is a circular opening (10) which has the same radius and centre point as opening (6). At (11) a bolt (12) has been placed according to FIG. 3. Between base plate (2) and pivoting plate (8) is a metal ring (13) with the same thickness as friction disc (9). The head of the bolt (12) fits in a sliding fashion into opening (6). Opening (6) makes it possible to pivot the ski line bracket under friction for about 25 degrees. Bolt (12) with nut (14) can be fastened tightly on various locations in opening (10). In this fashion bolt (12) forms an adjustable stopper. Opening (10) allows an adjustability up to about 15 degrees. Nut (14) can also be a cap nut so that no sharp parts are sticking out.

Figure 4:
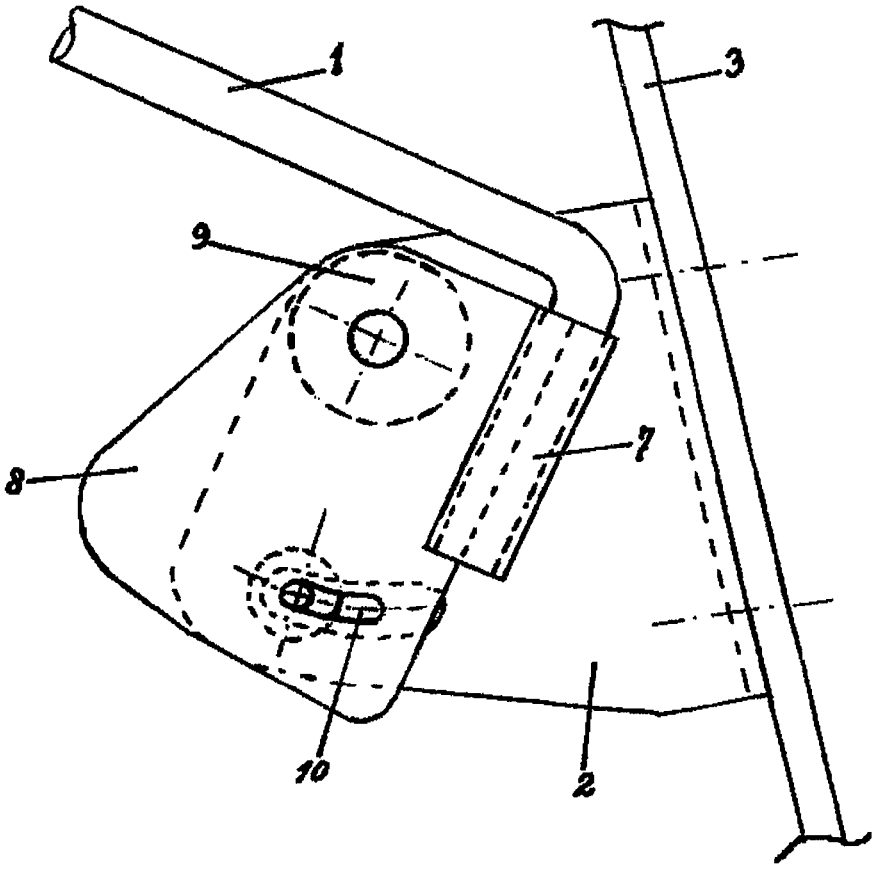
FIG. 4 shows the mounting device in side view with the ski line bracket in tilted position.

The device works as follows:

With bolt (12) the bracket is set into horizontal position, depending on the angle of the transom (3) of the boat, also the angle of the boat when navigation can be taken into account. The pivoting plate (8) with the ski line bracket (1) can pivot upwards under friction about 25 degrees when the boat tilts more while accelerating from standstill or due to other heavy stress or in case the outboard engine must be tilted out of the water. This situation is depicted in FIG. 4. Opening (6) determines the maximum pivoting range.

The invention claimed is:

1. A mounting of a ski line bracket comprising:

a ski line bracket having a circular bar which directly holds a pulley of a ski line, and mounted to a pivoting plate that rotates around a point, wherein the point is anchored to a base plate; and a bolt fitting into a first circular opening;

wherein the first circular opening is formed in one of the pivoting plate and the base plate;

wherein the bolt in combination with a second circular opening forms an adjustable stopper;

wherein the second circular opening is formed in one of the pivoting plate and the base plate;

wherein when the first circular opening is formed in the base plate, the second circular opening is formed in the pivoting plate; and, wherein, when the first circular opening is formed in the pivoting plate, the second circular opening is formed in the base plate.

2. A mounting according to claim 1, wherein a setting angle of the pivoting plate set by the adjustable stopper using the bolt is between 10 and 25 degrees.

3. A mounting according to claim 2, wherein the pivoting plate pivots with friction over an angular degree between 20 and 30 degrees, in combination with the second circular opening.

4. A mounting according to claim 3, wherein the bolt is fastened to the pivoting plate with a cap nut.

5. A mounting according to claim 2, wherein the pivoting plate pivots substantially without friction over an angular degree between 20 and 30 degrees, in combination with the second circular opening.

6. A mounting according to claim 5, wherein the bolt is fastened to the pivoting plate with a cap nut.

7. A mounting according to claim 2, wherein the bolt is fastened to the pivoting plate with a cap nut.

8. A mounting according to claim 1, wherein the pivoting plate pivots with friction over an angular degree between 20 and 30 degrees, in combination with the second circular opening.

9. A mounting according to claim 8, wherein the bolt is fastened to the pivoting plate with a cap nut.

10. A mounting according to claim 1, wherein the pivoting plate pivots substantially without friction over an angular degree between 20 and 30 degrees, in combination with the second circular opening.

11. A mounting according to claim 10, wherein the bolt is fastened to the pivoting plate with a cap nut.

12. A mounting according to claim 1, wherein the bolt is fastened to the pivoting plate with a cap nut.

13. A mounting according to claim 1, wherein the base plate is mounted to the transom of a boat.

14. A mounting of a ski bracket, comprising:

a ski line bracket mounted to a pivoting plate that rotates around a rotating point, wherein the rotating point is anchored to a base plate;

a second plate; and a bolt fitting into a circular sliding opening formed in one of the base plate and the second plate;

wherein the bolt is adjustably fixed in a circular adjustment opening formed in one of the base plate and the second plate;

wherein when the circular sliding opening is formed in the base plate, the circular adjustment opening is formed in the second plate; and, wherein, when the circular sliding opening is formed in the second plate, the circular adjustment opening is formed in the base plate; and wherein the bolt forms an adjustable pivoting stopper that slides within the circular sliding opening.

15. A mounting according to claim 14, wherein the bolt is provided with a cap nut for fixing the bolt in the adjustment opening.

16. A mounting according to claim 14, wherein a friction means is provided between the base plate and the second plate.

17. A mounting according to claim 14, wherein each of the circular sliding opening and the circular adjustment opening has the same radius with respect to the rotating point.

18. A mounting according to claim 14, wherein the ski line bracket has a circular part.

19. A mounting of a ski line bracket comprising:

a ski line bracket mounted to a pivoting plate that rotates around a point, wherein the point is anchored to a base plate; and a bolt fitting into a first circular opening;

wherein the first circular opening is formed in one of the pivoting plate and the base plate;

wherein the bolt in combination with a second circular opening forms an adjustable stopper;

wherein the second circular opening is formed in one of the pivoting plate and the base plate;

wherein when the first circular opening is formed in the base plate, the second circular opening is formed in the pivoting plate; and, wherein, when the first circular opening is formed in the pivoting plate, the second circular opening is formed in the base plate;

wherein a setting angle of the pivoting plate set by the adjustable stopper using the bolt is between 10 and 25 degrees; and wherein the first circular opening is an arcuate opening having an arc of 15 degrees.

20. A mounting according to claim 19, wherein the second circular opening is an arcuate opening having an arc of about 25 degrees and is dimensioned to receive a head of the bolt.

* * * * *